US005094630A

United States Patent [19]

Jammet

[11] Patent Number: 5,094,630

[45] Date of Patent: Mar. 10, 1992

[54] MULTIPLE SOCKET ATTACHMENT

[76] Inventor: Jean-Claude Jammet, 4237 Louis Payette, Chomedey, Laval, Quebec, Canada, H7T 4Y2

[21] Appl. No.: 659,716

[22] Filed: Feb. 25, 1991

[51] Int. Cl.[5] ..... H01R 13/00

[52] U.S. Cl. ..... 439/652

[58] Field of Search ..... 439/650-652, 439/654

[56] References Cited

U.S. PATENT DOCUMENTS 3,005,179 10/1961 Holt ..... 439/652

3,076,077 1/1963 Lindeman ..... 439/652

*Primary Examiner*—Joseph H. McGlynn

*Attorney, Agent, or Firm*—Roland L. Morneau

[57] ABSTRACT

A multiple socket attachment for accommodating a plurality of cord plugs is made of a flat box-like receptacle containing four electrical conductors made of metal strips disposed in recess channels. The receptacle is provided with two longitudinal rectilinear channels and a plurality of transversal channels leading to slots through the lateral walls. Each longitudinal channel contains two superposed metal strips in spaced relationship and each transversal channel containing a plurality of transversal strips in adjacent relationship. Each conductor has an L-shaped leg extending through one face of the receptacle and consisting of prongs located to fit into conventional wall outlet.

7 Claims, 8 Drawing Sheets

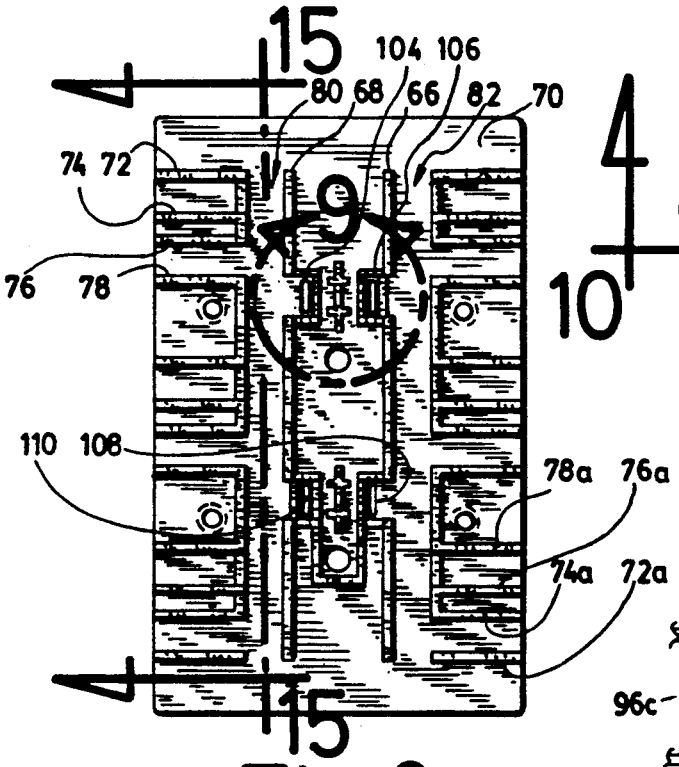
Fig.8
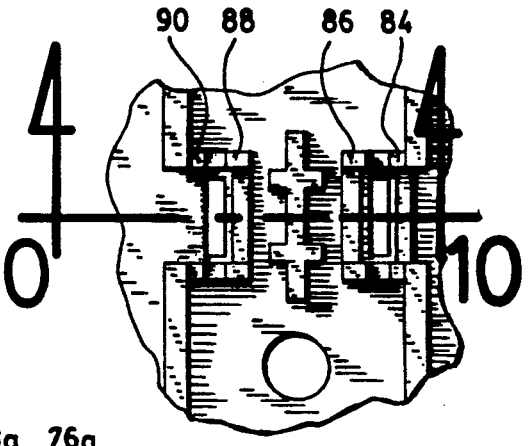
Fig.9
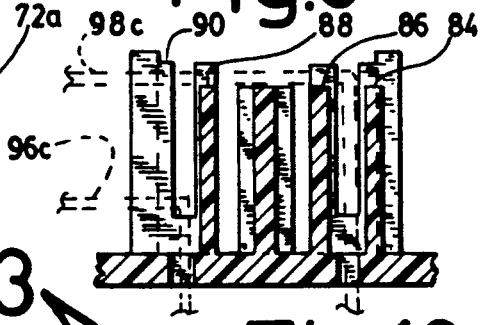
Fig.10
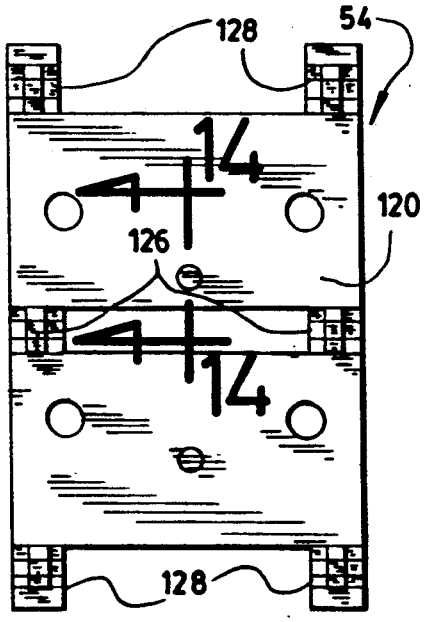
Fig.11
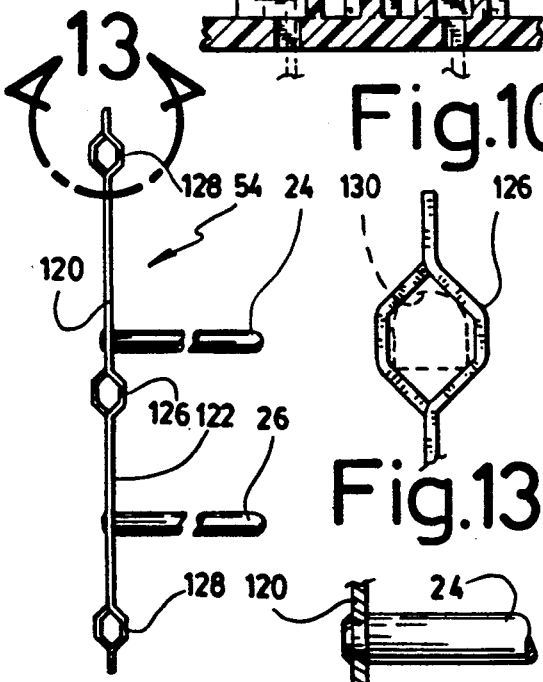
Fig.12
Fig.13
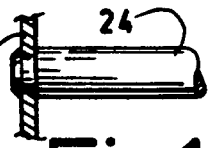
Fig.14

MULTIPLE SOCKET ATTACHMENT

BACKGROUND OF THE INVENTION

1. Field of the Invention

This invention relates to an attachment adapted to be connected to a conventional electric wall outlet and capable of accommodating multiple electrical appliance cord plugs and in particular six, eight, ten or a higher multiple of pairs of cord plugs.

2. Prior Art

U.S. Pat. No. 3,005,179 discloses a multiple electric outlet which is limited to six outlets. The design of the inner conductors defines a complex path and the superpogition of positive and negative conductors carries a risk of short-circuit.

The present applicant has a pending application Ser. No. 457,102 describing a multiple socket attachment which can accommodate a maximum of only four cord plugs. In this application, the conductors extend crosswise between the lateral walls through which the cord plugs are inserted.

SUMMARY OF THE INVENTION

In the present multiple socket attachment, the main strip of the conductors extends parallel to the lateral walls through which the cord plugs are inserted. The design of the conductors is simple and leads to the possibility of accommodating an unlimited number of pairs of cord plugs.

The present multiple socket attachment comprises a rectangular box-like receptacle having two parallel lateral walls provided with a plurality of pairs of slots for receiving the tines of electrical appliance cord plugs and two facing walls extending between the lateral walls. One of the facing walls comprise a plurality of internally projecting partitions defining channels. The attachment also includes four electrical conductors disposed in two of the channels. Each of the conductors extends from positions adjacent a plurality of the slots to a prong projecting perpendicularly outwardly through the one facing wall.

The channels compromise two symmetrical rectilinear channels logitudinally extending parallel to the lateral walls and a plurality of transversal channels extending perpendicularly from the longitudinal channels in the direction of the adjacent lateral wall and in line with each of the slots. The conductors comprise two pairs of conductors and each pair of conductors comprise a linear strip superposed in the longitudinal channels. Transversal strips laterally extend from the linear strips through each of the transversal channels. A spring contact is secured at the end of each transversal strip adjacent one of the slots. Each prong comprises an L-shaped strip secured to each of the linear strips. The L-shaped strips are secured to the superposed linear strips forming a pair of adjacently positioned prongs adapted to fit into the conventional wall outlet. The superposed conductors are maintained in a spaced relationship by abutting over the edge of the partitions which are crenelated.

The attachment may also be provided with grounding prongs fixed to a grounding plate inside the receptacle, while the grounding prongs extend outside the receptacle to fit into the conventional electric wall outlet. The grounding plate is also provided with spring clamps laterally disposed and adjacent each pair of slots for resiliently clamping and grounding the tines of the cord plugs projecting through the slots.

BRIEF DESCRIPTION OF THE DRAWINGS

FIG. 8 is an internal elevation view of the cover shown in FIG. 7, FIG. 9 is an enlarged view of the portion 9 shown in FIG. 8, FIG. 10 is a cross-sectional view taken along line 10—10 of FIG. 9, FIG. 11 is a front view of a grounding plate mounted in the attachment shown in FIG. 7, FIG. 12 is a side view of the grounding plate shown in FIG. 11, FIG. 13 is an enlarged view of portion 13 shown in FIG. 12, FIG. 14 is an enlarged view of a grounding prong mounted on a portion of the grounding plate.

DETAILED DESCRIPTION OF THE INVENTION

Figure 1:
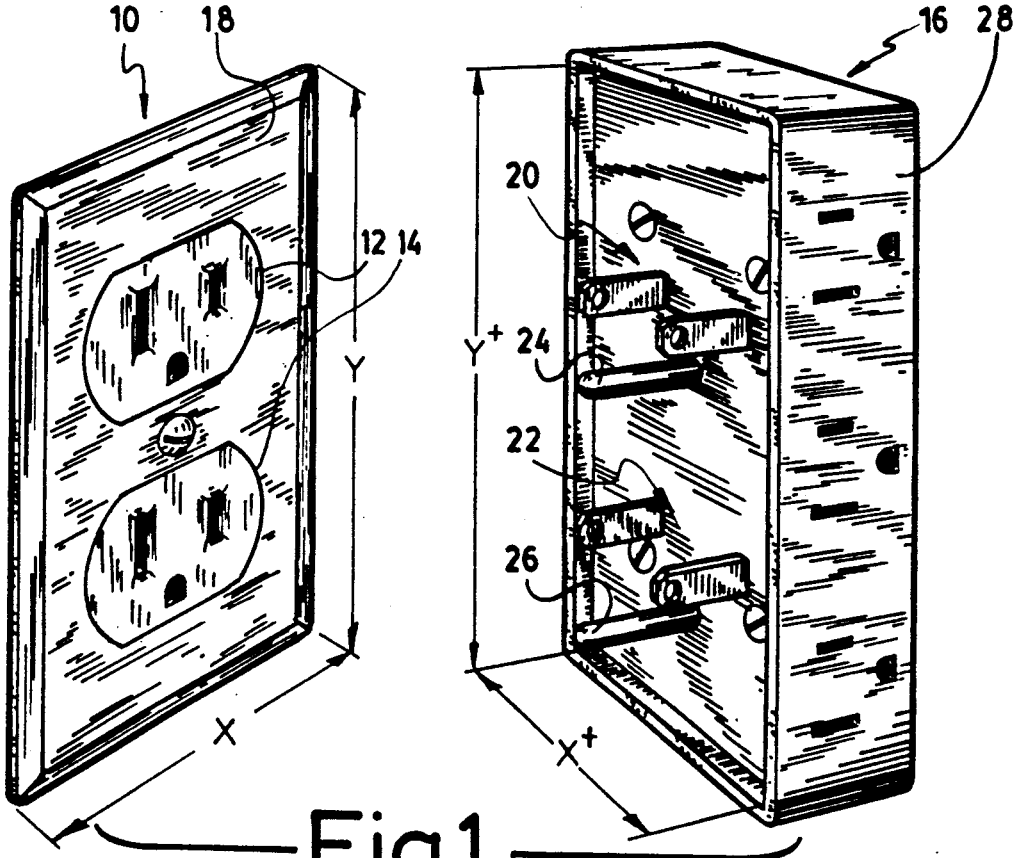
FIG. 1 is an exploded view of a conventional electric wall outlet and a multiple socket attachment according to the invention.

FIG. 1 illustrates the combination of a conventional electrical wall outlet 10 which has two sockets 12 and 14 and a multiple socket attachment 16 which is adapted to fit into the sockets 12 and 14. The outlet 10 is covered by a rectangular wall plate 18 and the socket attachment 16 has a periphery slightly exceeding the periphery of the wall plate 18 in order to fit over it. Similarly, two pairs of prongs 20 and 22 with their matching grounding prong 24 and 26 are located to fit precisely into the corresponding sockets 12 and 14. Each lateral wall 28 and 30 of the attachment 16 is provided with three sets of slots adapted to receive the tines of six electrical appliance cord plugs 30–42. These plugs are laterally introduced in the attachment 16. Such an arrangement, differs from the plugs which projects perpendicularly from the wall. Because they project a smaller distance away from the wall, they have many advantages. In particular, they allow a piece of furniture to rest closer to a wall having such an attachment. Furthermore, plugs such as 32–42 do not have the tendency to pull away from the wall the socket attachment such as 16 contrary to the plugs which are introduced from the front in the commonly known socket attachment.

Figure 4:
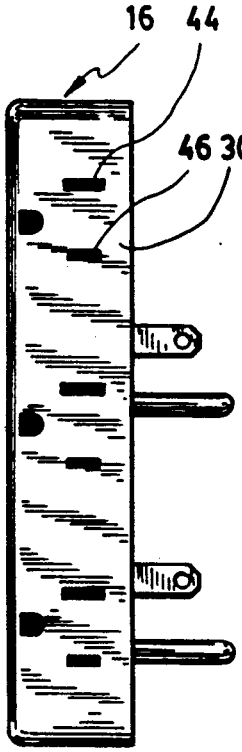
FIGS. 3, 4 and 5 are respectively rear and side views of an embodiment of the novel attachment.
Figure 3:
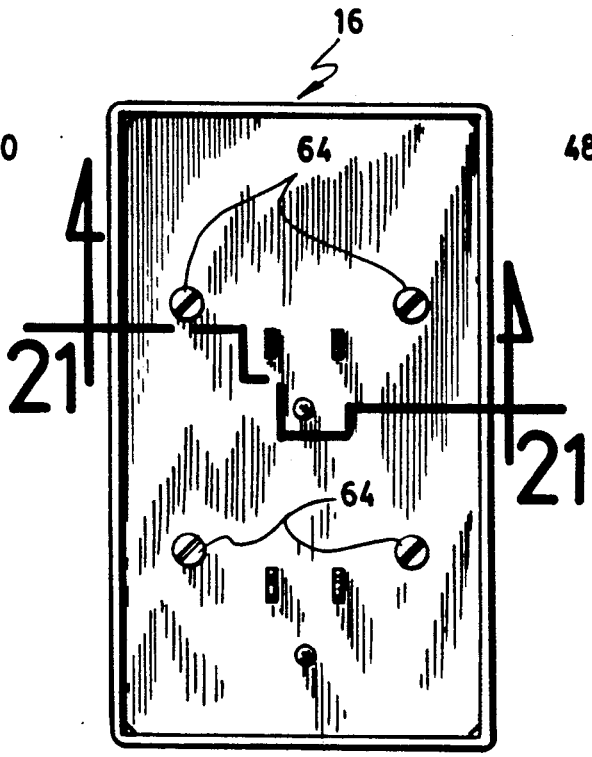
Figure 5:
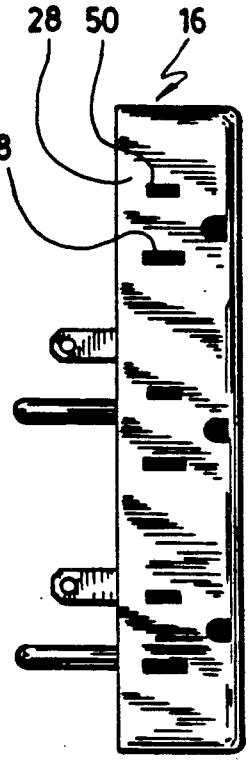
Figure 4A:
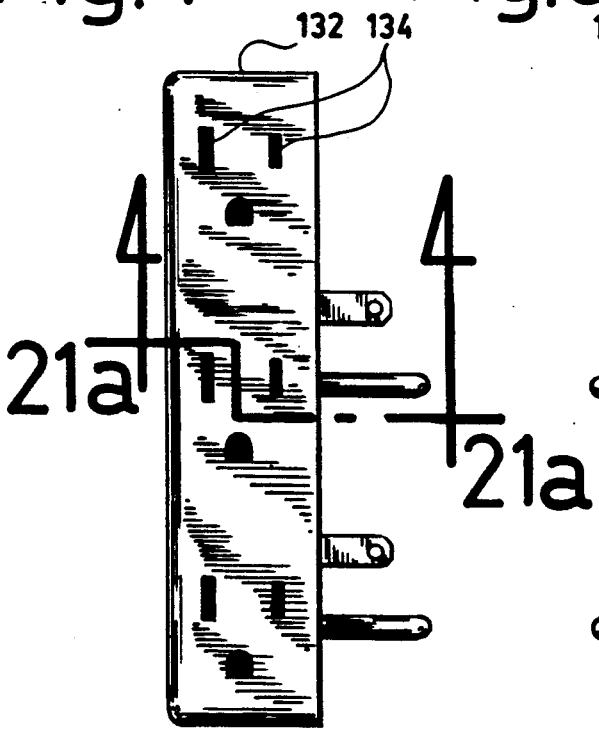
FIGS. 4*a* and 5*a* are two side views of alternative embodiments of the invention.
Figure 5A:
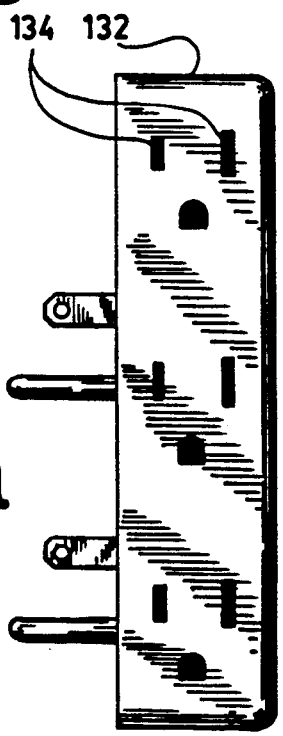

The attachment 16 is provided with wide and narrow slots 44 and 46 to suitably accept the polarized plugs which have a wide and a narrow prong according to the first embodiment as shown in FIGS. 3, 4 and 5. The narrow slot 46 is below the wide slot 44 on one lateral wall 30 (FIG. 4) while on the other lateral wall 28 the position of the slots is reversed that is the wide slot 48 is below the narrow slot 50 (FIG. 5). In other embodiments, as may be seen later, the wide and narrow slots can be positioned side by side on the same vertical plane as shown in FIGS. 4*a* and 5*a*.

Figures 6, 7:
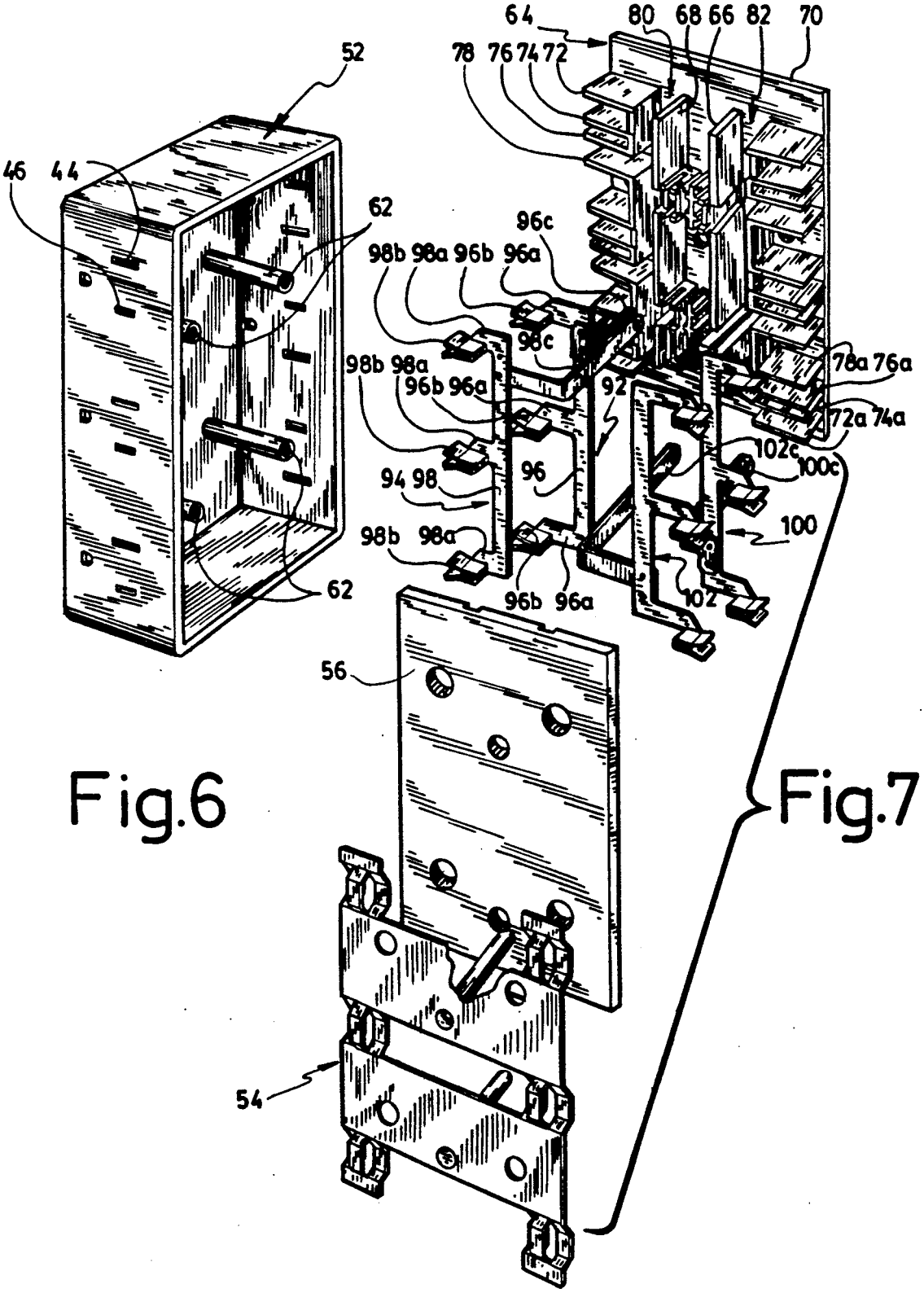
FIG. 6 is a perspective view of an empty and open box-like receptacle for the socket attachment.
FIG. 7 is an exploded view of the superposed elements to be fitted inside the receptacle shown in FIG. 6.
Figure 15:
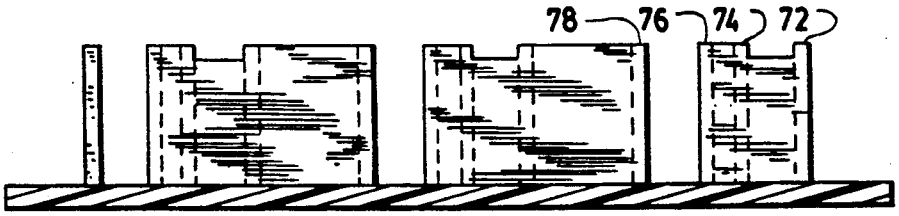
FIG. 15 is a cross-sectional view taken along line 15—15 of the cover shown in FIG. 8.

FIG. 6 illustrates a empty box-like receptacle 52 in which is mounted in sequence a grounding plate 54 an insulating sheet 56, a set of four conductors 58 and a cover 60. A set of 4 internally threaded sleeves 62 projects inside the receptacle which are adapted to penetrate through correspondingly located holes in plate 54 and sheet 56 and be retained to the cover 60 by screws 64, such as shown in FIG. 3.

The four conductors 58 are held by partitions internally projecting from the cover 60. The partitions consist of two main partions 66 and 68 which are parallel and adjacently disposed each side of a longitudinal central axis of the base plate 70. The main partions 66 and 68 are longitudinally aligned while a set of transversal partions such as 72, 74, 76 and 78 extends towards the edge of the base 70. The space between the main partition 68 and the transversal partitions 72–78 and the other partitions on the other side of the base plate 70 forms a channel 80 adapted to receive the longitudinal strips of two of the conductors 58 as explained later. Another channel 82 similar to channel 80 is provided on the opposite side of the base plate 70 between the main partition 66 and the adjacent transversal partitions such as 72*a*, 74*a*, 76*a* and 78*a* and the other transversal partitions located above the previous ones.

The space between the two main partitions 66 and 68 also have dividing partitions to hold the prongs of the conductors 58 as explained later. These partitions consist of partitions 84 and 86 for one of the prongs and 88 and 90 for the other prong. These partitions are particularly illustrated in FIGS. 9 and 10.

Let us consider conductors 92 and 94 which are adapted to extend into the channel 80. These conductors are made of a linear strips 96 and 98, three transversal strips 96*a* and spring contact 96*b*. Conductor 94 is similarly made of a linear flat strip 98 with three transversal strips 98*a* from which extends three spring contact 98*b*.

The conductor 92 has a grounding prong 96*c* constituted by an L-shaped arm having one portion extending in the direction opposite the transversal strip 96*a* and another portion orthogonally extending through the base plate 70 between the partitions 88 and 90. Similarly, conductor 98 has a grounding prong 98*c* constituted of an L-shaped arm having a portion extending in a direction opposite the direction of the transversal strips 98*a* and another portion orthogonolly extending through the base plate 70 between the partitions 84 and 86 (see FIG. 10).

The description of the conductors 92 and 94 substantially applies equally to the conductors 101 and 102 which are disposed in the channel 82. The conductor 100 has a grounding prong 100*c* which extended through the slot 108 (FIG. 8) and the conductor 102 has a grounding prong which extends through the slot 110 (FIG. 8).

The upper edge of the longitudinal partition adjoining the transversal partitions such as 72*a*, 74*a*, 76*a* and 78*a* are crenelated for supporting the transversal strips of the conductors 100 and 102 in space relationship, so that one strip lies against the base plate 70 while the other one is supported by a portion of the crenelated edge of the partition adjoining the transversal partitions such as 72–78 and 72*a*–78*a*.

Figure 2:
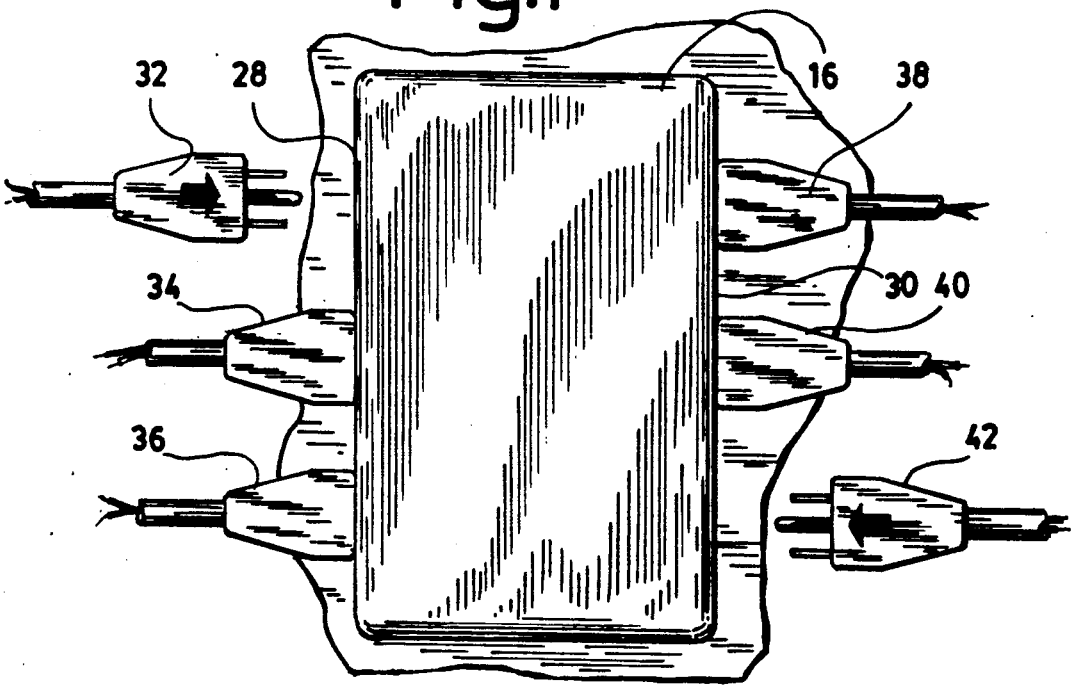
FIG. 2 is a front view of the multiple socket attachment mounted on a wall outlet and to which a plurality of electrical appliance cord plugs are attached.

The transversal channels extending between the transversal partitions 72–78 and the other transversal partitions on the same side as the base plate 70 as well as the partitions 72*a*–78*a* and the other partitions on the opposite side as the base plate 70 are located so that the spring contacts are lined up with the slots such as 44 and 46 provided for receiving the tines of the plugs such as shown in FIG. 2. More specifically the plug 32 of FIG. 2 is intended to be introduced in the slots 44 and 46 such as shown in FIG. 6. Similarly, the positioning of the prongs 96*c* and 98*c* are positioned so as to be aligned with the slots 104 and 106 (FIG. 8) while the prongs 100*c* and 102*c* are vertically positioned on the strips 100 and 102 respectively to be aligned with the slots 108 and 110.

Figure 16:
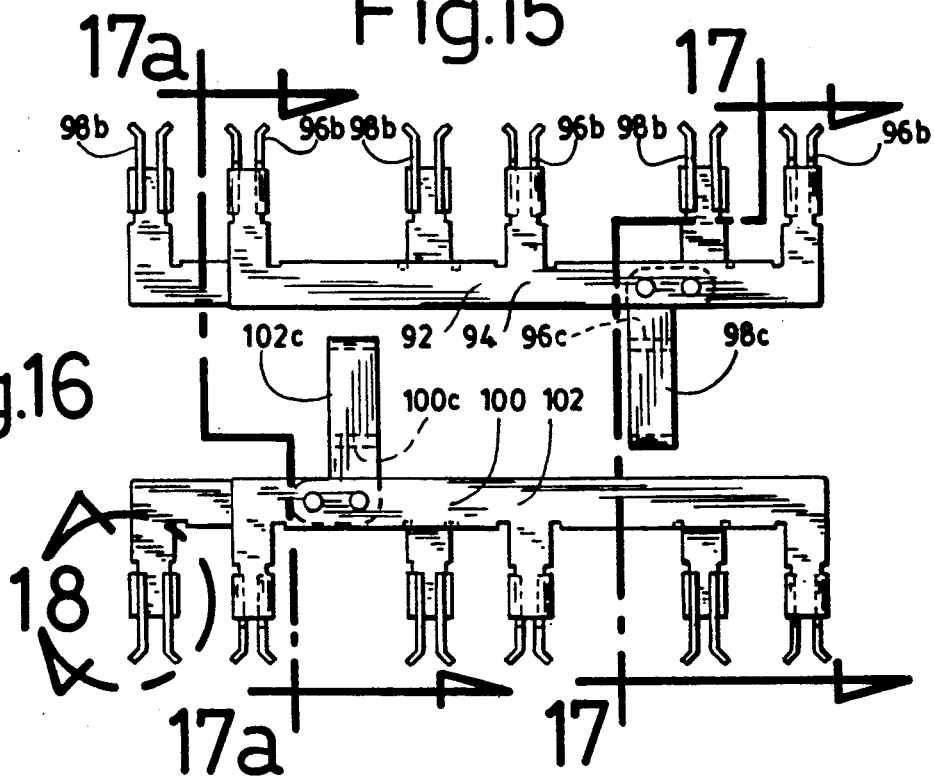
FIG. 16 is a plan view of the conductors to be installed in the channels of the cover shown in FIG. 8, FIGS. 17 and 17*a* are cross-sectional views of the conductors taken along lines 17—17 and 17*a*—17*a* in FIG. 16.

FIG. 16 is a front view of the conductors 92, 94, 100 and 102 as seen in FIG. 7. Conductors 92 and 94 are superposed and adjacently positioned relative to the superposed conductors 100 and 102. FIG. 16 particularly identifies the spring contacts 96*b* and 98*b* which are located to face the slots such as 44 and 46 shown in FIG. 4. The contact spring extending from the oppositely positioned conductors 100 and 102 which are not numerically identified are similarly located to face the oppositely positioned slots such as 48 and 50.

Figure 17:
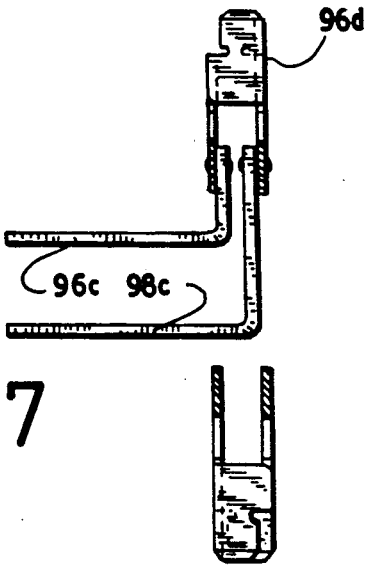
Figure 17A:
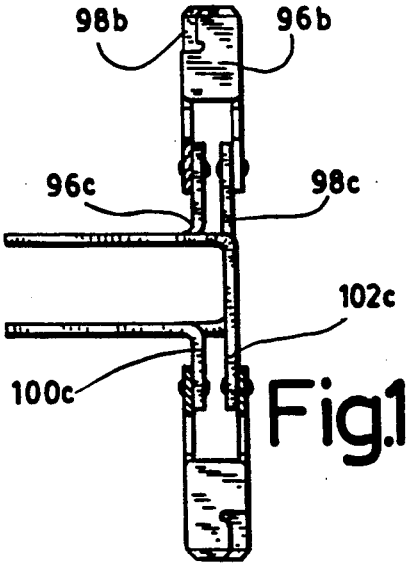

As seen in FIGS. 17 and 17*a* the tines 96*c* and 98*c* projects side by side in a parallel fashion for insertion into the wall outlet 10 shown in FIG. 1. Similarly, the tines 100*c* and 102*c* extends from the conductors 100 and 102 in a parallel relationship with the tines 96*c* and 98*c*.

Figure 18:
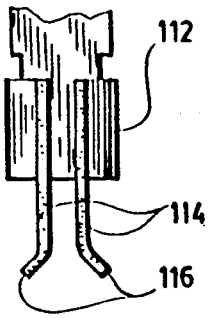
FIG. 18 is an enlarged view of a spring contact shown in encircled portion 18 of FIG. 16.
Figure 19:
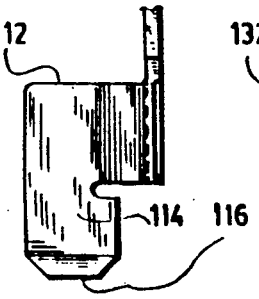
FIG. 19 is a side view of the spring contact shown in FIG. 18.
Figure 20:
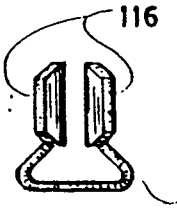
FIG. 20 is a end view of the spring contact shown in FIG. 18, FIG. 21 and 21*a* are cross-sectional views taken along lines 21—21 and 21*a*—21*a* of FIGS. 3 and 4*a* respectively.

FIGS. 18, 19 and 20 illustrates one embodiment of the spring contact wherein the metal from the conductor is punched out in such a shape to form a lobe 112 which ends with two forwardly projecting strips 114 splitting out at their forward end to face slots such as 44 and 46 and tightly receive the prongs of the plugs 30–42.

It is pointed out that the conductors are made from punched out strip of metal such as brass having lateral protecting portions adapted to be folded as previously described. The ground prongs 96*c*, 98*c*, 100*c* and 102*c* which have a L-shaped leg are welded or riveted at one end to the linear portion of the conductor at locations defined above. The production of such conductors is simplified considering the linearity of the strips of the conductors and of the channels 80 and 82 receiving them as well as the orthogonality of the transversal strips 98*a*. The embodiment illustrated and described in the present application is suitably designed for receiving six cord plugs 30–42 but the design according to the present invention can easily be adapted to receive a plurality of pairs of cord plugs by lengthening the linear strips and multiplying the transversal strips to the number of pairs of plugs desired.

Figure 21A:
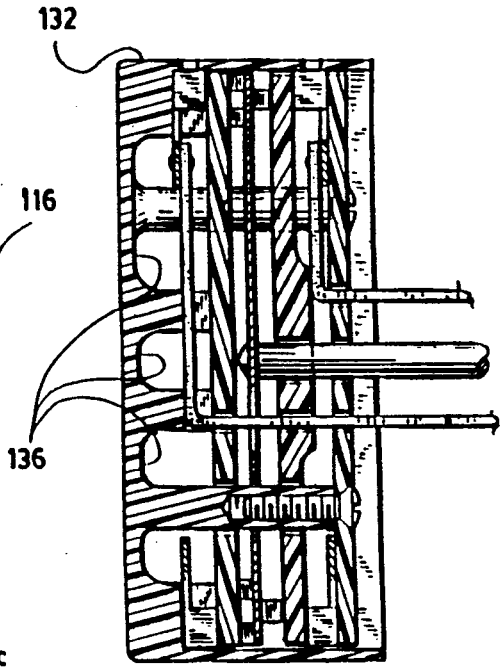
Figure 21:
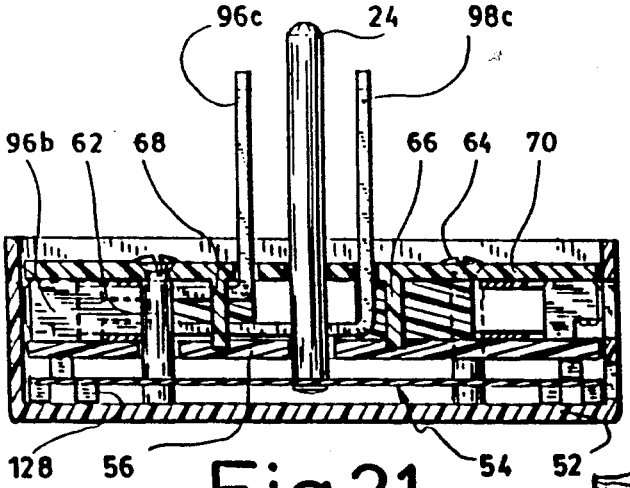
Figure 23:
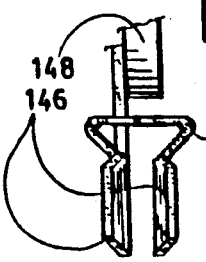
FIG. 23 is an enlarged view of a spring contact for a conductor as shown in FIG. 22.
Figure 24:
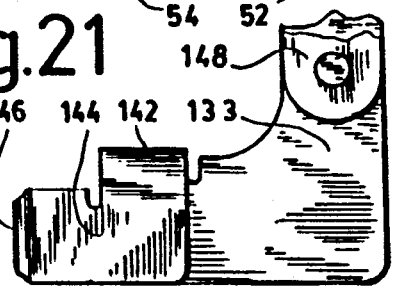
FIG. 24 is a side view of a portion of the conductor shown in FIG. 22 including a spring contact.
Figure 22:
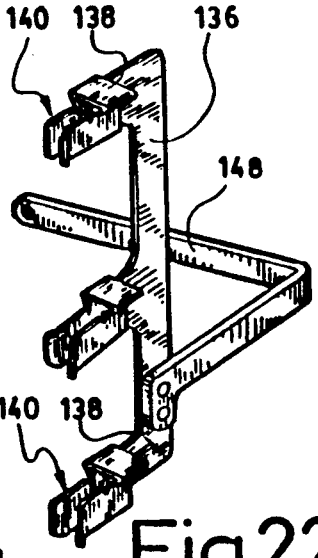
FIG. 22 is a perspective view of an alternative embodiment of a conductor to be installed in a receptacle as shown in FIGS. 4*a* and 5*a*.

As explained previously, the multiple socket attachment according to the invention may be limited to a pair of polarized prongs such as 20 and 22 without the use of a specific grounding prong. However, the present invention is suitably conceived to provide a grounding prong to be inserted into the wall outlet 10. For this purpose, a grounding plate 54 is inserted into the box-like receptacle 52 behind the conductors as shown in FIG. 7. Plate 54 shown in FIGS. 11–14, includes two laminas 120 and 122 joined by spring clamps or clips 126 and provided with similar spring clips 128 at the outer four corners 128 of the laminas 120 and 122. The spring clips are shaped so as to surround a grounding prong such as 130 shown in FIG. 13. The prongs such as prong 24 are riveted to the lamina 120 to maintain a rigid orientation perpendicular to the lamina 120 as shown in FIG. 14. FIG. 21 shows a cross-sectional view of an attachment as described above, along line 21—21, of FIG. 3. However, for a box-like receptacle 132 as shown in FIGS. 4*a* and 5*a*, wherein the slots 134 are parallel to the vertical axes of the receptacle and to the strip 136 (FIG. 22) of the corresponding conductors, the box-like receptacle 132 is slightly different as shown in FIG. 21*a* from the one shown in FIG. 21. FIG. 21*a* is a cross-sectional view along line 21*a*—21*a* of FIG. 4*a*. Considering that the slots 134 are positioned side by side, the back of the receptacle is made thicker but lightened by a pularity of grooves or recesses 136 provided on the inside of the box. The conductors used for this embodiment have essentially the same shape as shown in FIG. 2 but are provided with transversal strips extending into spring contacts 140 adapted to be parallel and in line the slots 134 shown 4*a* and 5*a*. The conductors, as shown in FIG. 22, can be made from blank sheets of metal, press, cut and folded to provide the shape of the spring clips 140. The latter is also made with a lobe 142 resiliently holding to fingers 144 spreading out as lips 146. The conductor shown in FIG. 22 has an L-shaped leg 148 serving as a ground prong similar to the ones described above.

Figure 25:
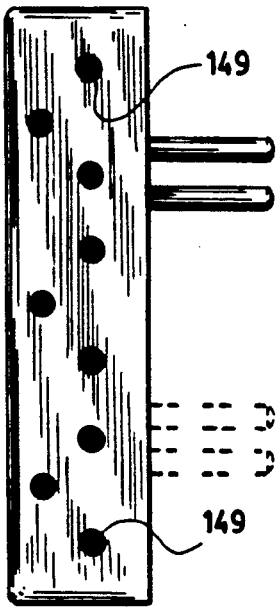
FIGS. 25–28, 25*a* and 27*a* are side and rear views of different alternative embodiments of multiple socket attachment according to the invention.
Figure 26:
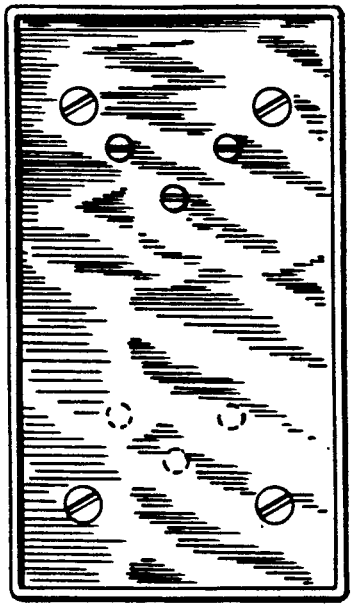
Figure 25A:
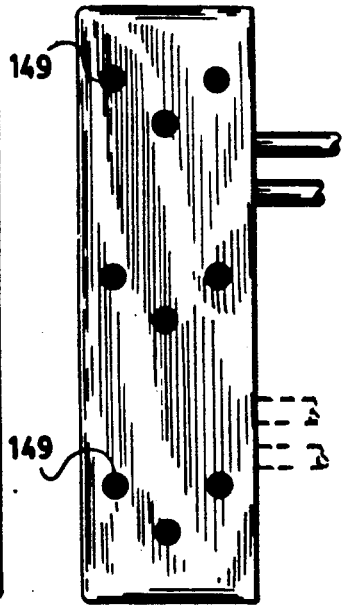
Figure 27:
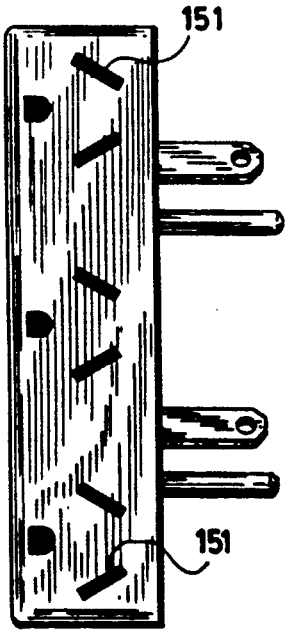
Figure 28:
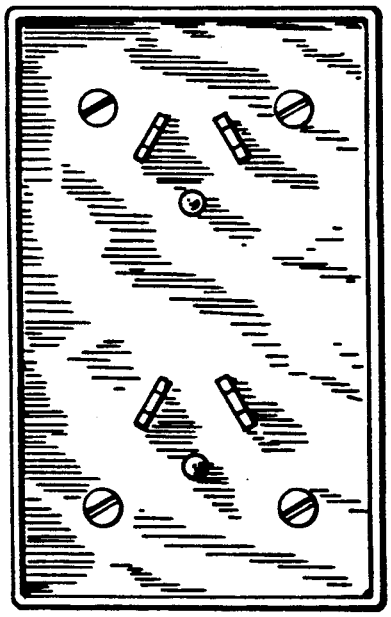
Figure 27A:
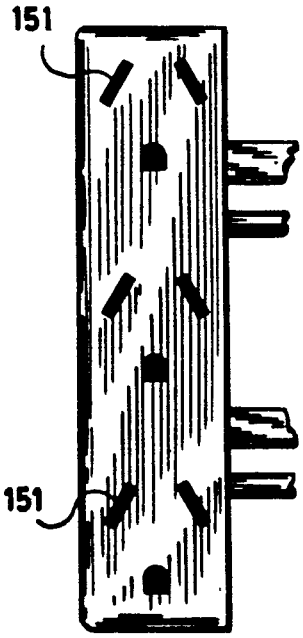

The present invention has also the flexibility of being adaptable to various types of multiple socket attachment used in various countries of the world. The attachment shown in FIGS. 25, 25*a* and 26 are provided with circular apertures 149 on their lateral walls and corresponding inner spring clips suitable for many European countries. The embodiment shown in FIGS. 27, 27*a* and 28 have slots 151 in the lateral walls which are angularly disposed relative to each other in each pair of slots. This arrangement is suitable for Australian regulations and can be easily made from the conductors described above.

Figure 29:
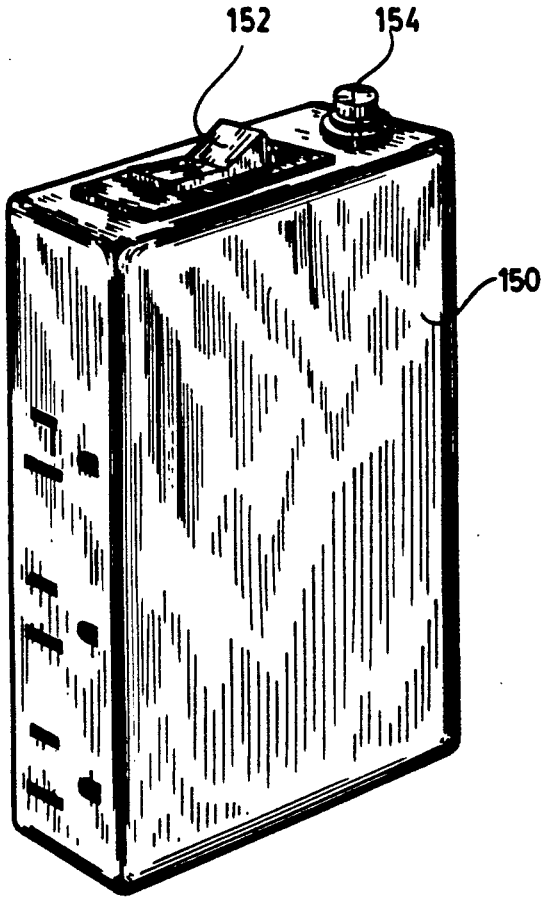
FIG. 29 is a perspective view of a box like receptacle including a switch and a reset button.
Figure 30:
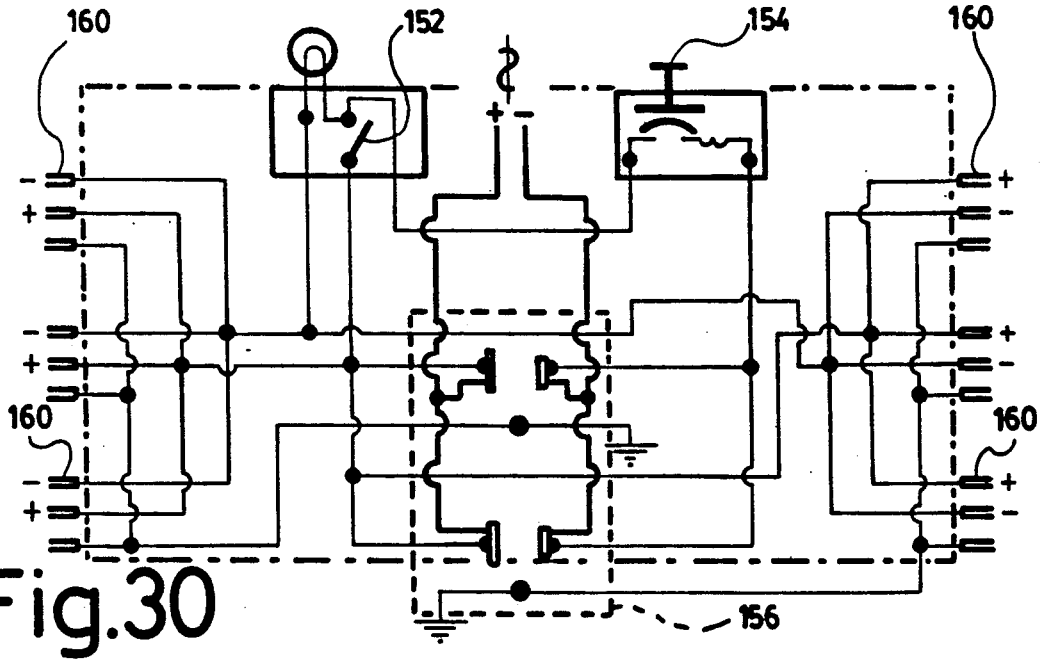
FIG. 30 is an electrical diagram including the switch and reset button used in FIG. 29.

The same arrangement as described above is mounted in the box-like receptacle 150 illustrated in FIG. 29. This embodiment is provided with a lighted switch 152 and a reset button 154. A circuit suitable for switching off the circuit inside the receptacle 150 is illustrated in FIG. 30. The part of the circuit enclosed by the dotted line 156 corresponds to the socket from the wall outlet such as 10. The spring clips such as 96*b* and 98*b* are symmetrically aligned on the right- and on the left-hand sides of the diagram identified by + and − fork-like members 160. The switch 152 can close the current from the spring clips to the circuit 156 and is adapted to be lighted when the socket receptacle 150 is in operation. However, such an attachment having a purality of outlets suitable to be connected to a pluraity of cord plugs, is liable to be overloaded. For this purpose, any overloading of the circuit is prevented by the reset device 154 and may be reconnected by the same device of known reset devices.

I claim:

1. A multiple socket attachment adapted to be inserted in a conventional electric wall outlet for electrically bridging the wall outlet and tines of a plurality of electrical appliance cord plugs, said attachment comprising:

a rectangular box-like receptacle having a peripheral wall including two parallel lateral walls provided with a plurality of pairs of slots for receiving the tines of said plugs and two facing walls extending between said lateral walls, one of said facing walls being removably mounted on said peripheral walls and comprising a plurality of internally projecting partitions defining channels, four electrical conductors disposed in said channels, each of said conductors extending from positions adjacent a plurality of said slots to a prong projecting perpendicularly outwardly through said one facing wall, said channels comprising two symmetrical rectilinear channels longitudinally adjacent and parallel to and substantially coextensive with said lateral walls, and transversal channels extending perpendicularly from the rectilinear channels in the direction of the adjacent lateral wall and in line with each of said slots, said conductors comprising two pairs of electrically separated conductors, each conductor of each pair of conductors comprising a linear strip being superposedly disposed in said rectilinear channels along the full length of said rectilinear channels, transversal strips laterally extending from each of said linear strips through each of said transversal channels, a spring contact secured at the end of each of said transversal strips adjacent one of said slots, each prong comprising an L-shaped strip being secured at one end to one of said superposed linear strips for forming a pair of adjacently positioned prongs adapted to fit into said conventional wall outlet.

2. A multiple socket attachment as recited in claim 1, wherein each of said L-shaped strips having said pair of prongs comprises one arm orthogonally extending from each of said linear strips, one arm of each of said pair of L-shaped strips being longer than the other arm of said pair of L-shaped strip and overlapping the latter, said one arm being secured to the one of said superposed linear strips away from said one of said facing walls.

3. A multiple socket attachment as recited in claim 2, wherein partitions are crenelated along edges away from said one facing wall for abuting the superposed conductors in spaced relationship.

4. A multiple socket attachment as recited in claim 3 comprising an insulating plate disposed between said superposed conductors for preventing electrical contact therebetween.

5. A multiple socket attachment as recited in claim 4, comprising a grounding plate spacedly mounted from said conductors in a plane parallel to and adjacent said facing wall opposite said one of said facing walls, said grounding plate having a pair of grounding prongs orthogonally projecting from said plate through said one facing wall, a spring clamp laterally disposed on said grounding plate at locations adjacent each of said pair of spring contacts for resiliently clamping a grounding tines of said cord plugs.

6. A multiple socket attachment as recited in claim 5, comprising an insulating sheet disposed between said grounding plate and said conductors for electrically insulating the latter from the grounding plate.

7. A multiple socket attachment as recited in claim 6, wherein the other of said facing walls is integrally fixed to said peripheral wall and removably mounted from said grounding plate, internally threaded sleeves projecting from said other facing wall towards said one facing wall, said one facing wall being provided with holes for receiving screws threadedly engaging said sleeves for holding said one facing wall against said peripheral wall and for closing said receptacle and maintaining the conductors and the grounding plate in their aforementioned position.

* * * * *